US006947065B2

(12) United States Patent
Kaji

(10) Patent No.: US 6,947,065 B2
(45) Date of Patent: Sep. 20, 2005

(54) IMAGE FORMING APPARATUS HAVING A ROTATING POLYGONAL MIRROR

(75) Inventor: Hajime Kaji, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 10/660,676

(22) Filed: Sep. 12, 2003

(65) Prior Publication Data

US 2004/0062584 A1 Apr. 1, 2004

(30) Foreign Application Priority Data

Sep. 30, 2002 (JP) ..... 2002-287175

(51) Int. Cl.[7] ..... G03G 15/01; B41J 2/47
(52) U.S. Cl. ..... 347/116; 399/301; 347/235
(58) Field of Search ..... 347/116–119, 235, 347/250; 399/301

(56) References Cited

U.S. PATENT DOCUMENTS

| | | | | |
|---|---|---|---|---|
| 6,144,680 | A | 11/2000 | Kaji et al. | 372/38 |
| 6,151,053 | A | 11/2000 | Watanabe et al. | 347/115 |
| 6,188,419 | B1 * | 2/2001 | Katamoto et al. | 347/129 |

FOREIGN PATENT DOCUMENTS

| | | |
|---|---|---|
| JP | 7-123195 | 5/1995 |
| JP | 7-322022 | 12/1995 |
| JP | 9-292582 | 11/1997 |

* cited by examiner

*Primary Examiner*—Huan Tran
(74) *Attorney, Agent, or Firm*—Fitzpatrick, Cella, Harper & Scinto

(57) ABSTRACT

A method for controlling an image forming apparatus for forming a color image by superposing images formed at image forming units, each provided for a corresponding one of a plurality of color components, includes a first skipping step of skipping part of a main-scanning synchronizing signal in a first image forming unit for forming an image of a first color component, a first generation step of generating a sub-scanning reference signal based on the main-scanning synchronizing signal skipped in the first skipping step, a first exposure-scanning control step of controlling exposure scanning in a second image forming unit based on the main-scanning synchronizing signal skipped in the first skipping step and the sub-scanning reference signal generated in the first generation step, a second generation step of generating a sub-scanning reference signal in the second image forming unit for forming an image of a second color component, based on the sub-scanning reference signal generated in the first generation step, a second skipping step of performing skipping by determining a timing of skipping of the main-scanning synchronizing signal in the second image forming unit based on the sub-scanning reference signal generated in the second generation step, and an exposure-scanning control step of controlling exposure scanning in the second image forming unit based on the main-scanning synchronizing signal skipped in the second skipping step and the sub-scanning reference signal generated in the second generation step.

7 Claims, 15 Drawing Sheets

IMAGE FORMING APPARATUS HAVING A ROTATING POLYGONAL MIRROR

BACKGROUND OF THE INVENTION

1. Field of the Invention

The present invention relates to an image forming apparatus for forming an image by projecting light onto a rotating polygonal mirror.

2. Description of the Related Art

Image forming apparatuses, such as laser printers, copiers, facsimile apparatuses and the like, having a plurality of electrophotographic image forming units, have been known as conventional image forming apparatuses (for example, refer to Japanese Patent Application Laid-Open (Kokai) No. 07-123195 (1995)). Each image forming unit of such an image forming apparatus includes a semiconductor-laser unit for projecting a light beam, for example, modulated with image data onto a photosensitive member, a rotating polygonal mirror for performing main scanning on the photosensitive member by deflecting the laser beam from the semiconductor-laser unit by being rotatably driven by a polygonal-mirror driving motor, a PLL (phase-locked loop) control unit for controlling the revolution speed of the polygonal-mirror driving motor based on a reference-frequency signal, and a synchronism sensor for generating a main-scanning synchronizing signal (BD signal) by receiving reflected light from each mirror surface of the rotating polygonal mirror. By controlling exposure scanning on the photosensitive member with a laser beam corresponding to image data based on an output timing of a predetermined image-writing enabling signal and an output timing of the main-scanning synchronizing signal, images formed on respective image forming units are superposed without producing position deviation (for example, refer to Japanese Patent Application Laid-Open (Kokai) No. 09-292582 (1997)).

Since an image forming apparatus having a plurality of image forming units forms a color image by superposing toners of a plurality of colors, a position control technique that is more precise than for a monochromatic (black-and-white) printer is required.

In a color-image forming apparatus, a sheet conveying speed, i.e., an image forming speed (process speed) is sometimes changed depending on the type of a sheet, environment and the like. However, since a polygonal-mirror driving motor usually performs the above-described control, there is the possibility that rotation non-uniformity increases if the revolution speed of the polygonal-mirror driving motor is changed, and particularly in a color-image forming apparatus, the quality of a formed image is degraded.

Accordingly, when changing the sheet feeding speed, image formation is usually performed by skipping some lines without changing the revolution speed of the polygonal-mirror driving motor, i.e., the rotation speed of the rotating polygonal mirror. For example, when the sheet conveying speed is changed to 1/2 of the original speed, scanning is performed by skipping one line in two lines. When the sheet conveying speed is changed to 1/4 of the original speed, scanning is performed by skipping one line in four lines (for example, refer to Japanese Patent Application Laid-Open (Kokai) No. 07-322022 (1995)).

When forming a monochromatic (black-and-white) image by skipping some lines while reducing the sheet feeding speed, a timing of skipping some lines will not cause a problem.

However, in a color-image forming apparatus in which images of predetermined colors are formed by a plurality of image forming units, and the images of the respective colors are transferred onto a recording sheet in a superposed state, if image formation is performed without taking into consideration of a timing of line skipping in image forming units of respective colors at stages posterior to an image forming unit of a reference color, there is the possibility that images of respective colors deviate within ±1 line (when skipping one line in two lines).

SUMMARY OF THE INVENTION

It is an object of the present invention to provide an image forming apparatus and a method for controlling the same in which the above-described problems are solved.

It is another object of the present invention to provide an image forming apparatus and a method for controlling the same in which, when the image forming speed is changed, images formed at respective image forming units can be superposed without causing deviation, without changing the rotation speed of a rotating polygonal mirror.

According to one aspect, the present invention relates to a method for controlling an image forming apparatus for forming a color image by superposing images formed at image forming units, each provided for a corresponding one of a plurality of color components. The method includes a first skipping step of skipping part of a main-scanning synchronizing signal in a first image forming unit for forming an image of a first color component, a first generation step of generating a sub-scanning reference signal based on the main-scanning synchronizing signal skipped in the first skipping step, a first exposure-scanning control step of controlling exposure scanning in a second image forming unit based on the main-scanning synchronizing signal skipped in the first skipping step and the sub-scanning reference signal generated in the first generation step, a second generation step of generating a sub-scanning reference signal in a second image forming unit for forming an image of a second color component, based on the sub-scanning reference signal generated in the first generation step, a second skipping step of performing skipping by determining a timing of skipping of the main-scanning synchronizing signal in the second image forming unit based on the sub-scanning reference signal generated in the second generation step, and an exposure-scanning control step of controlling exposure scanning in the second image forming unit based on the main-scanning synchronizing signal skipped in the second skipping step and the sub-scanning reference signal generated in the second generation step.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
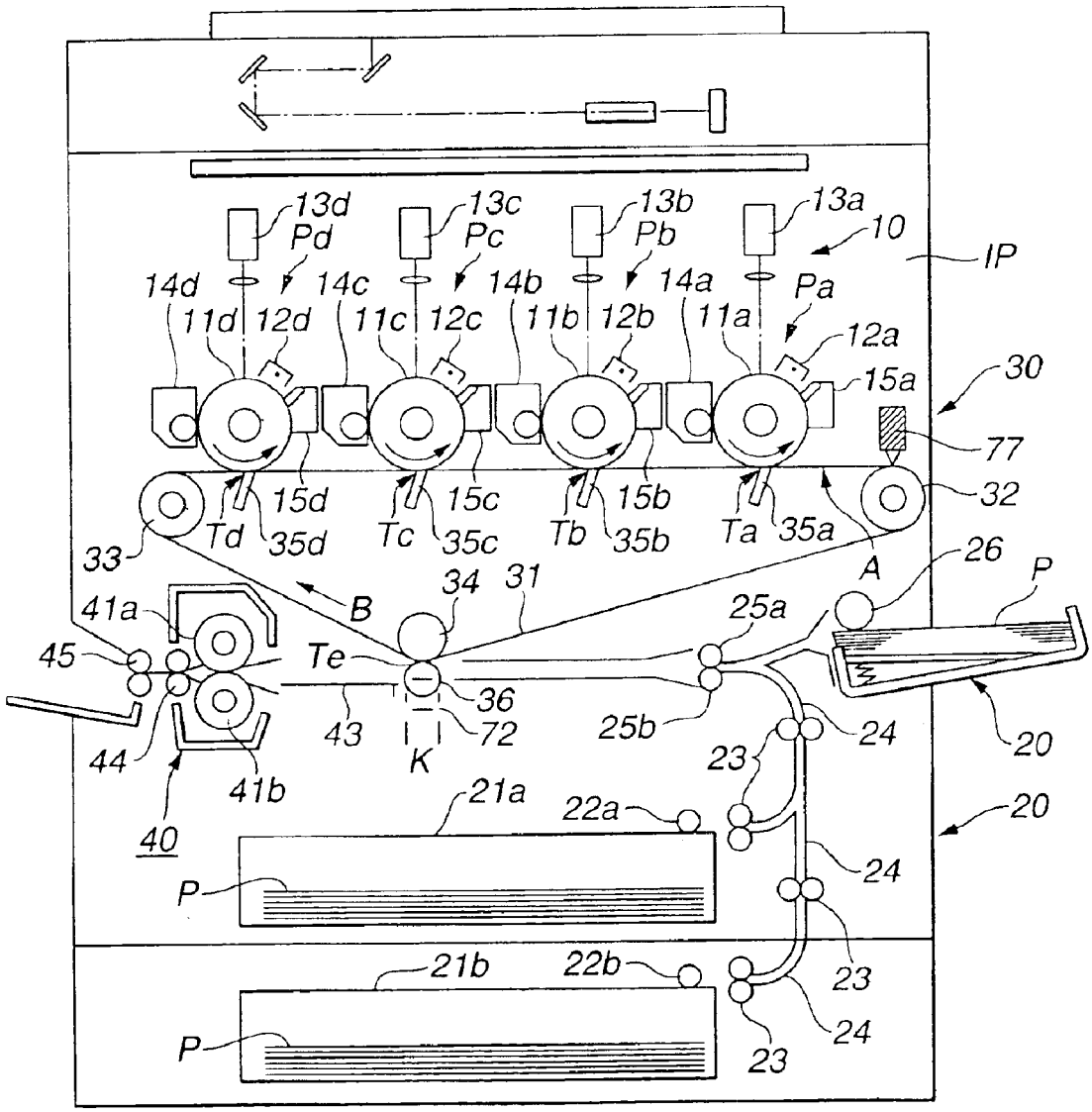
FIG. 1 is a schematic cross-sectional view illustrating the configuration of an image forming apparatus according to an embodiment of the present invention.

FIG. 1 is a schematic cross-sectional view illustrating the configuration of a color-image forming apparatus according to the preferred embodiment. This color-image forming apparatus is an electrophotographic image forming apparatus, in which a plurality of color-image forming units are arranged in parallel.

An image output unit 1P includes an image forming unit 10, a sheet feeding unit 20, an intermediate transfer unit 30, a fixing unit 40, and a control unit (not shown) as main components. In the image forming unit 10, four stations Pa, Pb, Pc and Pd corresponding to four colors, i.e., black, cyan, magenta and yellow, respectively, having the same configuration are arranged in parallel.

The image forming unit 10 has the following configuration. That is, each of photosensitive drums 11*a*, 11*b*, 11*c* and 11*d*, each serving as an image bearing member, is supported at its center, and is rotatably driven in the direction of an arrow. Primary chargers 12*a*, 12*b*, 12*c* and 12*d*, laser-scanner units 13*a*, 13*b*, 13*c* and 13*d*, and developing devices 14*a*, 14*b*, 14*c* and 14*d* are disposed so as to face the outer circumferences of the photosensitive drums 11*a*, 11*b*, 11*c* and 11*d*, respectively, in the direction of rotation.

The primary chargers 12*a*–12*d* provide the surfaces of the photosensitive drums 11*a*–11*d*, respectively, with electric charges of a uniform charging amount. Then, by exposing the surfaces of the photosensitive drums 11*a*–11*d* with laser beams modulated with respective recording image signals by the laser-scanner units 13*a*–13*d*, respectively, corresponding electrostatic latent images are formed. The operation of each of the laser-scanner units 13*a*–13*d* will be described later.

Then, the electrostatic latent images are visualized by the developing devices 14*a*–14*d* accommodating developers (hereinafter termed "toners") of four colors, i.e., black, cyan, magenta and yellow, respectively. At portions downstream from image transfer regions Ta, Tb, Tc and Td where each of the visualized images is transferred onto an intermediate transfer member, the surfaces of the photosensitive drums 11*a*–11*d* are cleaned by scraping toner particles remaining on the photosensitive drums 11*a*–11*d* by cleaning devices 15*a*, 15*b*, 15*c* and 15*d*, respectively. According to the above-described process, image formation by each toner is sequentially performed.

The sheet feeding unit 20 includes cassettes 21*a* and 21*b*, and a manual insertion tray 27 for accommodating sheets of a recording material P, pickup rollers 22*a*, 22*b* and 26 for individually feeding sheets of the recording material P from the cassettes 21*a* and 21*b* and the manual insertion tray 27, respectively, a pair of sheet feeding rollers 23 and a sheet feeding guide 24 for conveying the recording material P fed from each pickup roller to registration rollers 25*a* and 25*b*, and the registration rollers 25*a* and 25*b* for feeding the recording material P to a secondary transfer region Te in synchronization with an image forming timing of the image forming unit 10.

Next, the intermediate transfer unit 30 will be described in detail. An intermediate transfer belt 31 is wound around a driving roller 32 for transmitting a driving force to the intermediate transfer belt 31, a tension roller 33 for providing the intermediate transfer belt 31 with an appropriate tension by being urged by a spring (not shown), and a driven roller 34 facing the secondary transfer region Te via the intermediate transfer belt 31. For example, PET (polyethylene terephthalate), PVdF (polyvinylidene fluoride) or the like is used as the material for the intermediate transfer belt 31.

A primary transfer plane A is formed between the driving roller 32 and the tension roller 33. The driving roller 32 is obtained by coating rubber (urethane or chloroprene) on the surface of a metal roller to a thickness of a few millimeters, in order to prevent slip with respect to the intermediate transfer belt 31. The driving roller 32 is rotatably driven by a pulse motor (not shown). Chargers 35*a*–35*d* for primary transfer are disposed behind the intermediate transfer belt 31 at primary transfer regions Ta–Td where the photosensitive drums 11*a*–11*d* face the intermediate transfer belt 31, respectively. A secondary transfer roller 36 is disposed so as to face the driven roller 34, to form a secondary transfer region Te by a nip with the intermediate transfer belt 31. The secondary transfer roller 36 is pressed against the intermediate transfer belt 31, serving as an intermediate transfer member, with an appropriate pressure.

At portions downstream from the secondary transfer region Te of the intermediate transfer belt 31, there are provided a brush roller (not shown) for cleaning the image forming surface of the intermediate transfer belt 31, and a waste-toner box (not shown) for accommodating waste toner.

The fixing unit 40 includes a fixing roller 41*a* incorporating a heat source, such as a halogen-lamp heater or the like, a roller 41*b* (sometimes also incorporating a heat source) pressed against the fixing roller 41*a*, a guide 43 for guiding the transfer material P to a nip portion formed between the pair of rollers 41*a* and 41*b*, and inner sheet-discharge rollers 44 and outer sheet-discharge rollers 45 for further guiding the transfer material P discharged from the pair of the rollers 41*a* and 41*b* outside of the apparatus.

The control unit includes a control substrate for controlling operations of mechanisms within the above-described respective units, a motor driving substrate (not shown), and the like. The control substrate mounts a microcomputer including a CPU (central processing unit), a ROM (read-only memory) and a RAM (random access memory), and controls various operations of the image forming apparatus based on programs stored in the ROM by utilizing the RAM as a working area or the like.

Next, the configuration of the laser-scanner unit will be described with reference to FIGS. 2 and 3.

Figure 2:
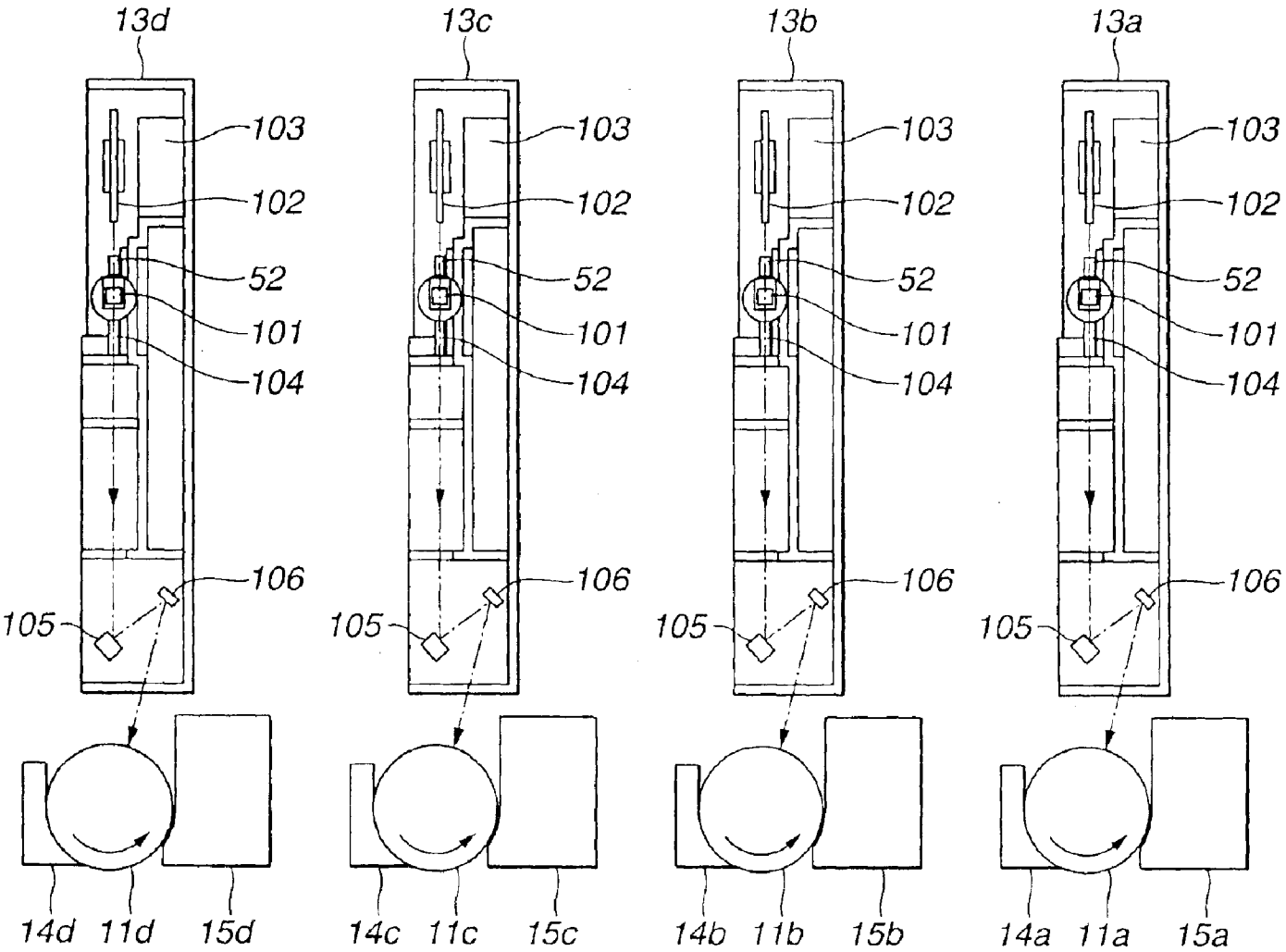
FIG. 2 is a diagram illustrating the state of arrangement of four laser-scanner units.
Figure 3:
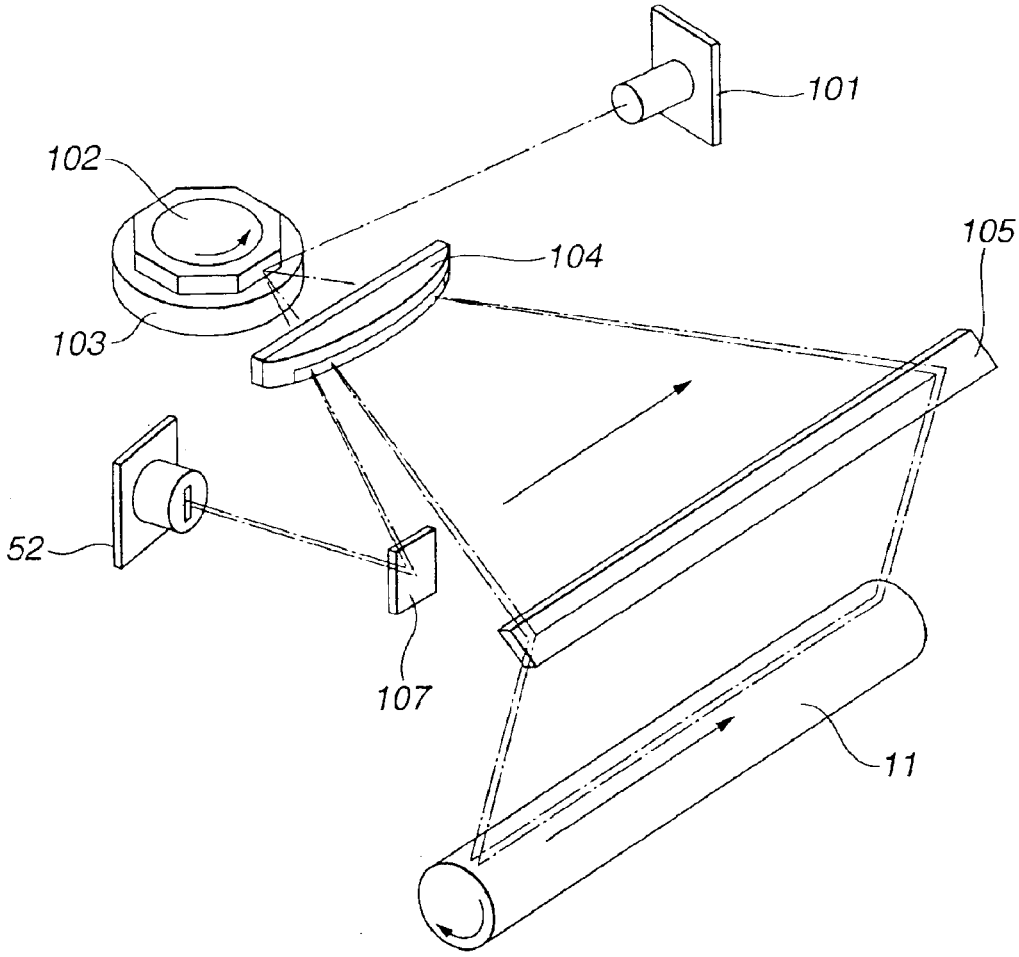
FIG. 3 is a perspective view illustrating the configuration of a laser-scanner unit.

The four laser-scanner units 13*a*–13*d* are arranged as shown in FIG. 2. The laser-scanner units 13*a*–13*d* have the same configuration so as to correspond to four colors, i.e., black, cyan, magenta and yellow, respectively. Although in FIG. 2, the laser-scanner units 13*a*–13*d* are disposed perpendicularly to the photosensitive drums 11*a*–11*d*, respectively, the laser-scanner units 13*a*–13*d* may be disposed horizontally without using a reflecting mirror 106 and by making the laser optical path in the form of L.

Next, the configuration of each of the laser-scanner units 13*a*–13*d* will be described in detail with reference to FIG. 3. FIG. 3 illustrate a case in which the laser optical path is made in the form of L. The laser-scanner unit includes a rotating polygonal mirror 102, and a laser-scanner motor (a polygonal-mirror driving motor) 103 for rotatably driving the rotating polygonal mirror 102. The number of surfaces of the rotating polygonal mirror 102 is determined by parameters, such as the printing speed, resolution and the like. A laser diode 101 operates as a light source for exposure. The laser diode 101 is turned on or off in accordance with an image signal or a control signal by a driving circuit (not shown). A modulated laser beam emitted from the laser diode 101 is projected onto the rotating polygonal mirror 102.

The rotating polygonal mirror 102 rotates in the direction of an arrow. In accordance with the rotation of the rotating polygonal mirror 102, the laser beam emitted form the laser diode 101 is reflected from a reflecting surface of the rotating polygonal mirror 102 as a deflecting beam whose angle continuously changes. The reflected laser beam is subjected to correction of distortion aberration, and the like by a lens group 104, and scans surface of the photosensitive drum 11 via a reflecting mirror 105 in a main scanning direction. A light beam reflected by one surface of the rotating polygonal mirror 102 corresponds to scanning for one line. According to the rotation of the rotating polygonal mirror 102, the laser beam emitted from the laser diode 101 sequentially scans the surface of the photosensitive drum 11 line by line in the main scanning direction.

In order to generate a scanning-start-position reference signal in the main scanning direction, a BD sensor 52 is disposed. It is ideal to dispose the BD sensor 52 near a scanning start position (near the photosensitive drum 11). Actually, however, the BD sensor 52 is disposed within each of the laser-scanner units 13*a*–13*d* by utilizing a reflecting mirror 107.

The laser beam reflected by each reflecting surface of the rotating polygonal mirror 102 is detected by the BD sensor 52 before scanning for each line. The laser beam detected by the BD sensor 52 (hereinafter termed a "BD signal") is used as a scanning-start reference signal in the main scanning direction, and synchronism of a writing start position in the main scanning direction for each line is obtained based on the BD signal. In addition, phase control and rotation-speed control of the laser-scanner motor 103 are performed using the BD signal output from the BD sensor 52.

Figure 4:
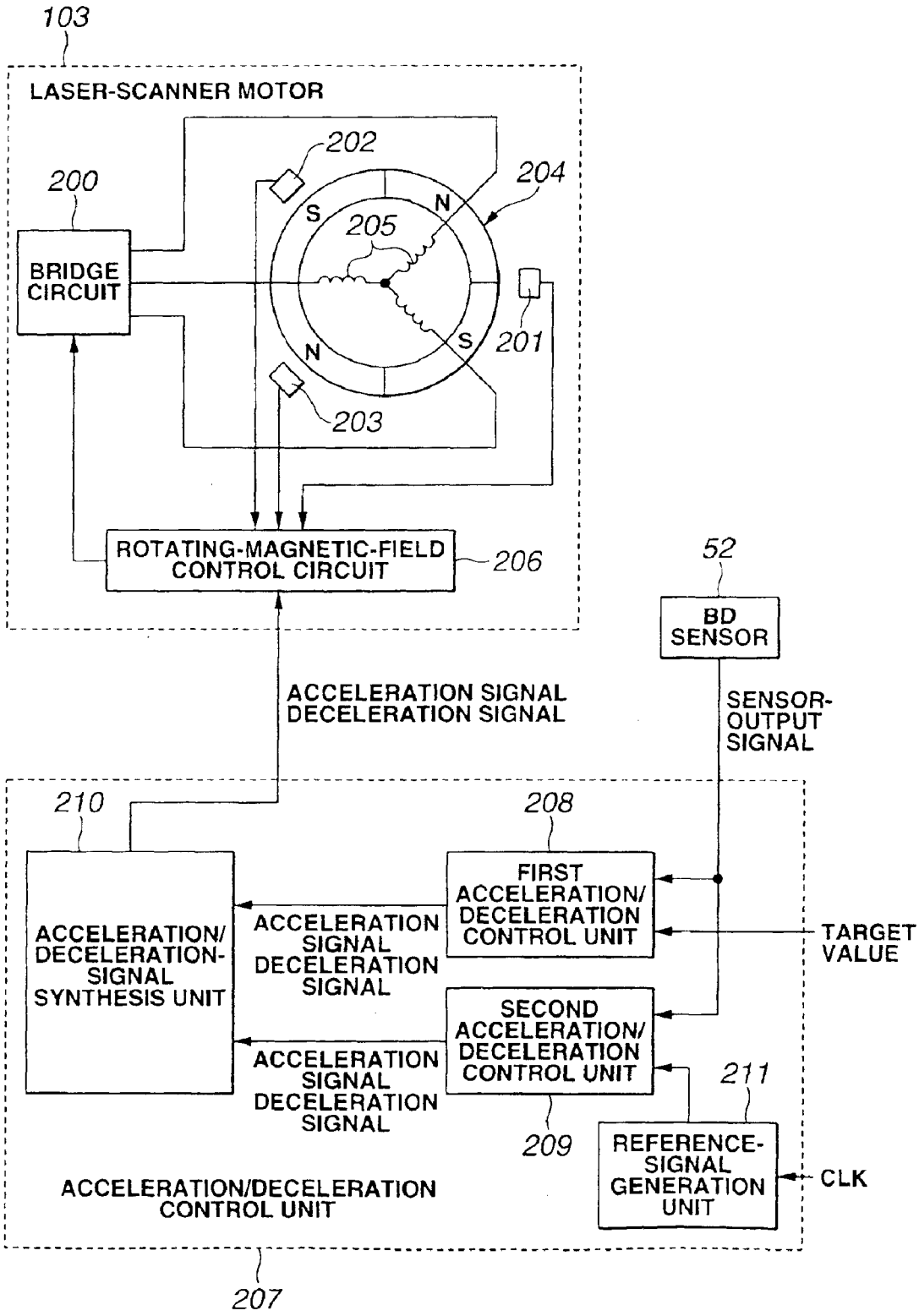
FIG. 4 is a block diagram illustrating the configuration of a control unit of a laser-scanner motor.

Next, a description will be provided of phase control and rotation-speed control of the laser-scanner motor 103 with reference to FIG. 4.

A brushless motor is used as the laser-scanner motor 103. A portion surrounded by broken lines in FIG. 4 indicates an equivalent circuit of the laser-scanner motor 103. Inductances 205 are subjected to star connection, and generate a rotating magnetic field by being excited by a bridge circuit 200. A magnetic pattern is formed in a rotor 204. The rotor 204 is rotated by the rotating magnetic field generated by the inductances 205, to rotatably drive the rotating polygonal mirror 102. Hall elements 201–203 detect the magnetic field formed in the rotor 204, and the detected magnetic field is input to a rotating-magnetic-field control circuit 206.

The rotating-magnetic-field control circuit 206 detects the rotating position of the rotor 204 based on output signals of the Hall elements 201–203, and controls the bridge circuit 200 so that the inductances 205 always generate the rotating magnetic field to allow the rotor 204 to rotate. An acceleration signal or a deceleration signal from an acceleration/deceleration control unit 207 is input to the rotating-magnetic-field control circuit 206, which performs speed control and phase control by performing rotation control of the laser-scanner motor 103 based on the input signal.

The acceleration/deceleration control unit 207 includes a first acceleration/deceleration control unit (speed control unit) 208, a second acceleration/deceleration control unit (phase control unit) 209, an acceleration/deceleration-signal synthesis unit 210 for synthesizing signals from the first acceleration/deceleration control unit 208 and the second acceleration/deceleration control unit 209, and a reference-signal generation unit 211.

First, control of the first acceleration/deceleration control unit 208 will be described with reference to the timing charts shown in FIGS. 5 and 6.

Figure 5:
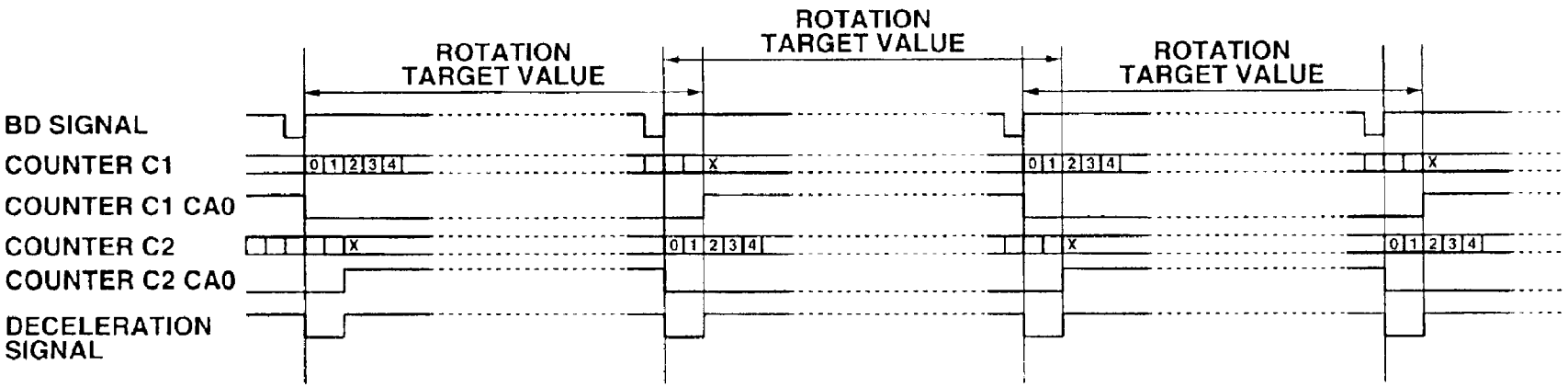
FIG. 5 is a timing chart illustrating rotation-speed control of a first acceleration/deceleration control unit (during deceleration control)

FIG. 5 illustrates timings when a deceleration signal is output. In the case of deceleration, as shown in FIG. 5, the interval between adjacent BD signals is counted alternately using two counters C1 and C2. When the count value reaches a set value X, each of the counters C1 and C2 stops a counting operation (the situation is the same in the case of acceleration shown in FIG. 6).

Upon stop of a counting operation, when the next BD signal is not input, i.e., when the speed of the laser-scanner motor 103 does not reach a set value, a deceleration signal is output until the next BD signal is input.

Figure 6:
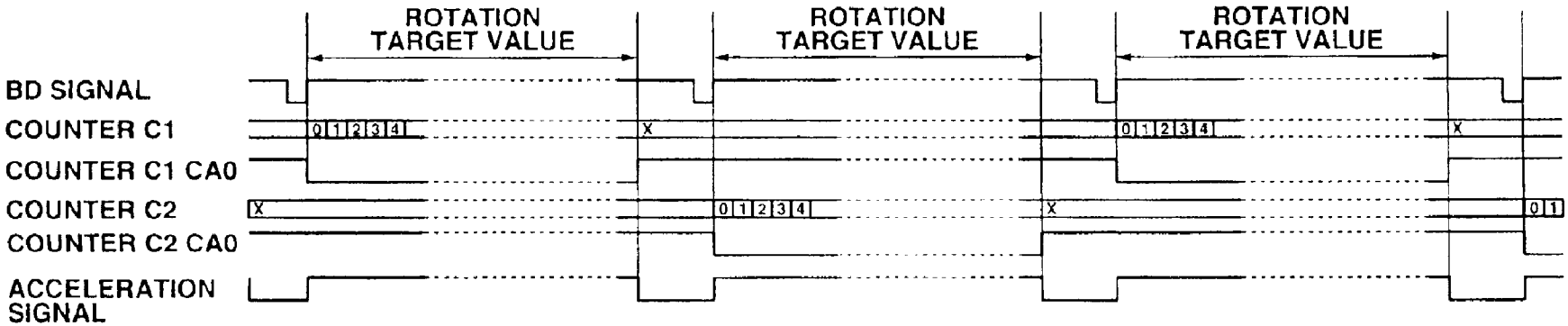
FIG. 6 is a timing chart illustrating rotation-speed control of the first acceleration/deceleration control unit (during acceleration control)

FIG. 6 illustrates timings when an acceleration signal is output. The acceleration signal is output when a BD signal is input before the count value reaches the above-described set value X, i.e., when the speed of the laser-scanner motor 103 exceeds the set value.

As shown in FIG. 6, after the BD signal has been input, an acceleration signal is output until the count value of the counter C1 or C2 reaches the set value X. By performing such control every time a BD signal is input, speed control is performed so that the laser-scanner motor 103 rotates at the target speed X.

Figure 7:
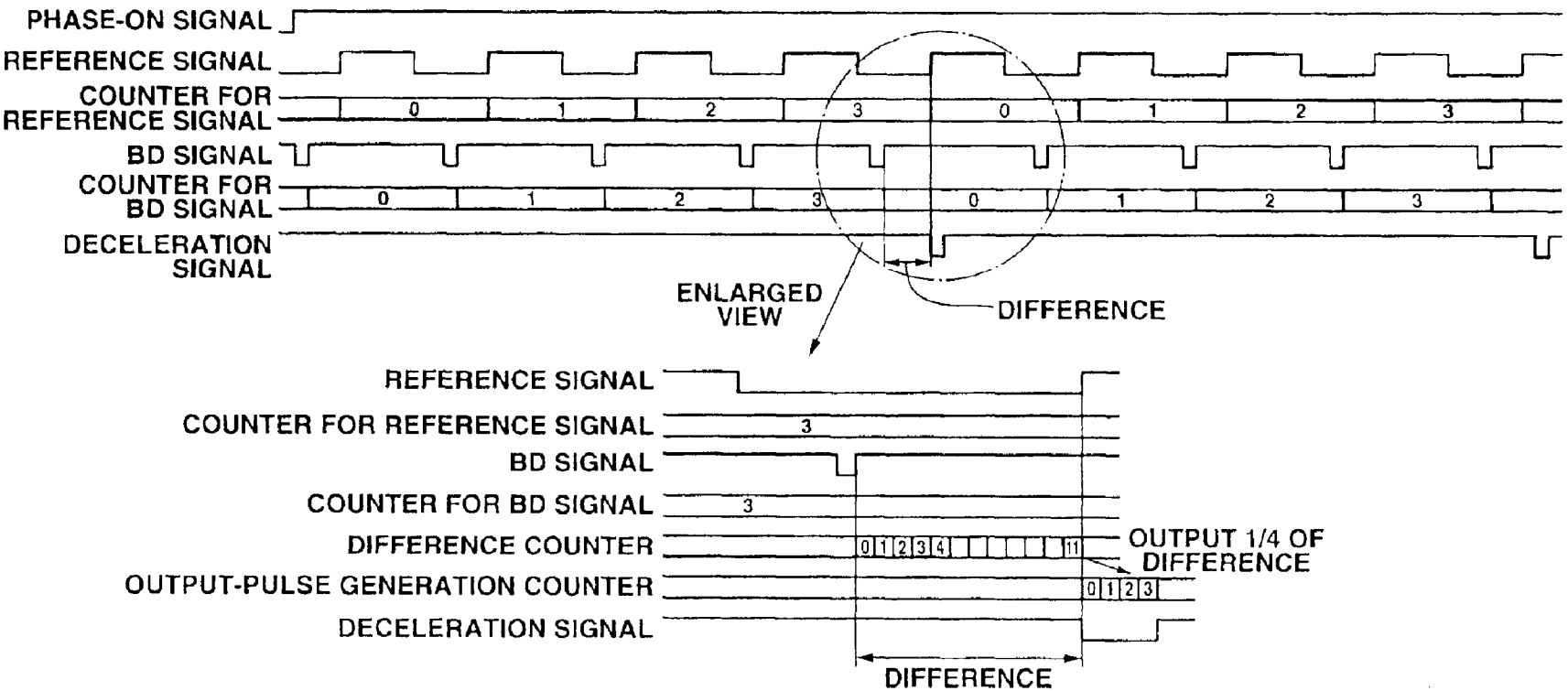
FIG. 7 is a timing chart illustrating phase control of a second acceleration/deceleration control unit (during deceleration control)
Figure 8:
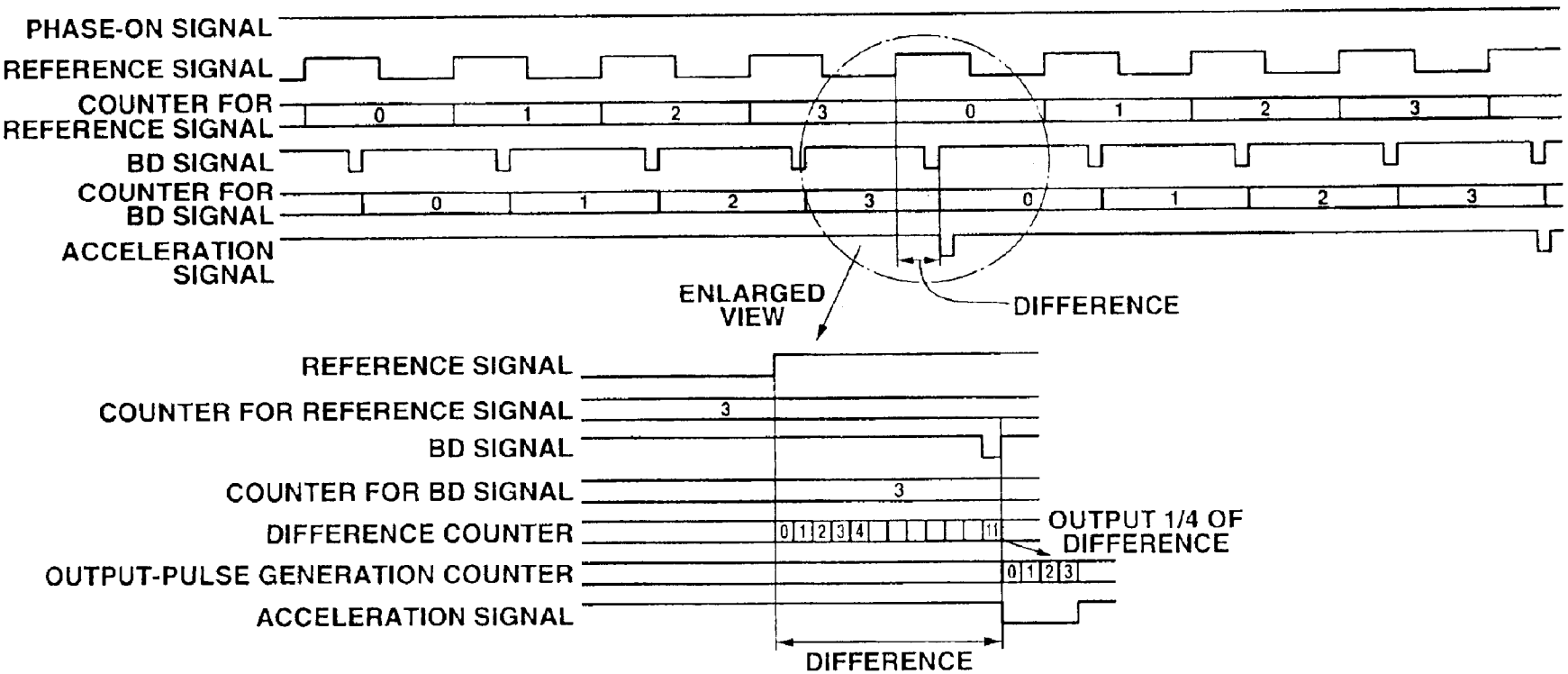
FIG. 8 is a timing chart illustrating phase control of the second acceleration/deceleration control unit (during acceleration control)

Next, a description will be provided of control of the second acceleration/deceleration control unit 209 with reference to the timing charts shown in FIGS. 7 and 8.

FIG. 7 illustrates a timing chart when a deceleration signal is output. When a phase-on signal is input to the second acceleration/deceleration control unit 209, a BD-signal counter for counting BD signals and a reference-signal counter for counting reference signals generated by the reference-signal generation unit 211 start counting, and the difference between the count value of one of the BD-signal counter and the reference-signal counter when the count value of that counter reaches a value set by the CPU or the like, and the count value of another counter is detected. The difference is detected using a difference counter. The difference counter counts the number of clock pulses that are sufficiently shorter than the period of the reference signal.

FIG. 7 illustrates a case in which the set value is "3" (start from "0"). When the count value of BD signals reaches the set value earlier than the reference signal, a deceleration signal calculated from the difference is output. For example, as shown in FIG. 7, a pulse having a width corresponding to 1/4 of the difference value is output (any other appropriate value will be adopted). Actually, the ratio of the width of the pulse to be output to the difference value is determined by the characteristics of the laser-scanner motor 103, and the like (FIG. 7 illustrates only an example).

FIG. 8 illustrates a timing chart when an acceleration signal is output. When the count value of reference signals reaches the set value earlier than the count value of BD signals, an acceleration signal calculated from the difference between the count values is output.

FIG. 8 illustrates a case in which, as in the case of deceleration, the set value is "3", and pulses having a width corresponding to 1/4 of the difference value are output. FIG. 8 illustrates only an example, and as in the case of deceleration, the ratio of pulse width to the difference value is determined by the characteristics of the laser-scanner motor 103, and the like. Although the case in which the set value is "3" has been described, more precise control can be performed if the set value is determined by also taking into consideration of the characteristics of the laser-scanner motor 103 and a signal output from the acceleration/deceleration control unit 208.

Acceleration/deceleration signals generated by the first acceleration/deceleration control unit 208 and the second acceleration/deceleration control unit 209 are synthesized by the acceleration/deceleration-signal synthesis unit 210, and rotation control of the laser-scanner motor 103 is performed by outputting the synthesized signal to the rotating-magnetic-field control circuit 206.

Although output timings of the acceleration signal and the deceleration signal are not particularly provided, the picture quality will be less degraded when acceleration and deceleration are performed in a non-image region than when they are performed in an image region. When performing acceleration and deceleration in a non-image region, since the input timing of the BD signal is known, it is, of course, possible to know an image region. Accordingly, it is desirable to detect the image region, and output an acceleration signal and a deceleration signal in another region.

Figure 9:
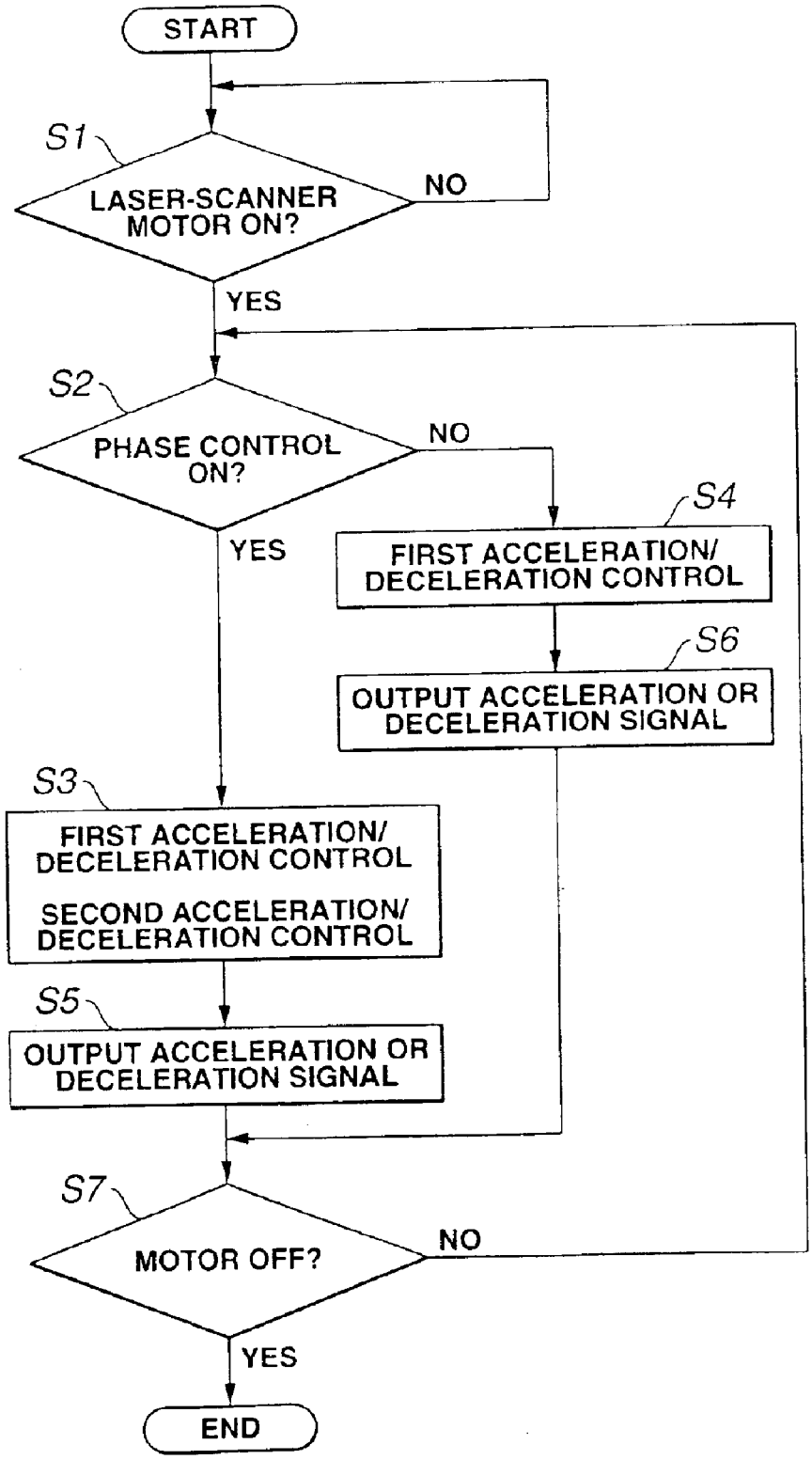
FIG. 9 is a flowchart illustrating acceleration/deceleration control of the laser-scanner motor.

Next, a description will be provided of phase control and speed control of the laser-scanner motor 103 with reference to the flowchart shown in FIG. 9.

First, it is awaited that the laser-scanner motor 103 is turned on (step S1). When the laser-scanner motor 103 is turned on, then, it is determined whether or not phase control (second acceleration/deceleration control) is in an on-state (step S2). Phase control need not be turned on in the case of a mono-color mode, and phase control is turned on only in the case of a full-color mode. That is, when phase control is not turned on (in the case of the mono-color mode), only first acceleration/deceleration control (speed control) is performed. Accordingly, in the mono-color mode, when phase control is not in an on-state, the control described with reference to FIGS. 5 and 6 (first acceleration/deceleration control) is performed, i.e., an acceleration or deceleration signal is generated so that the interval between adjacent BD signals is constant (step S4). By providing the rotating-magnetic-field control circuit 206 with the acceleration or deceleration signal, the revolution speed of the laser-scanner motor 103 is controlled (step S6). In the full-color mode, when phase control (second acceleration/deceleration control) is in an on-state, second acceleration/deceleration control (phase control) is executed as well as the above-described revolution-speed control (first acceleration/deceleration control) (step S3). The phase control is the control described with reference to FIGS. 7 and 8, in which a control signal for adjusting the phase of the BD signal with the reference signal is generated. Then, the signals generated in the first and second acceleration/deceleration controls are synthesized and the resultant signal is provided to the rotating-magnetic-field control circuit 206, to control the revolution speed and the phase of the laser-scanner motor 103 (step S5).

Upon completion of the processing in step S5 or S6, it is determined whether or not the laser-scanner motor 103 is turned off (step S7). If the result of the determination in step S7 is negative, the process returns to step S2, where it is again determined whether or not phase control is in an on-state. If the result of the determination in step S7 is affirmative, the control of the laser-scanner motor 103 is terminated.

Next, the overall operation of the image forming apparatus will be described.

When an image-forming-operation start signal is provided, a sheet feeding operation from a sheet feeding stage selected based on a selected sheet size or the like is started. For example, when feeding sheets from the upper sheet feeding stage, first, sheets of a transfer material P are individually fed from the cassette 21*a* by the pickup roller 22*a*. Then, the recording material P is conveyed to the registration rollers 25*a* and 25*b* by being guided in the sheet feeding guide 24 by the pair of sheet feeding rollers 23. At that time, the registration rollers 25*a* and 25*b* is in a stopped state, so that the leading edge of the recording material P contacts the nip portion. Then, the registration rollers 25*a* and 25*b* start rotation based on a timing signal for causing the image forming unit 10 to start image formation. The rotation start timing is set so that the recording material P coincides with a toner image subjected to primary transfer onto the intermediate transfer belt 31 by the image forming unit 10 at the secondary transfer region Te.

In the image forming unit 10, upon provision of the image-forming-operation start signal, electrostatic latent images are sequentially formed on the photosensitive drums 11*a*–11*d* of the respective colors. The timing of forming the electrostatic latent images is determined in accordance with the distance between the image forming units of the respective colors (the distance between adjacent photosensitive drums) starting from the photosensitive drum 11*d* present at the most upstream position in the direction of rotation of the intermediate transfer belt 31. A timing signal (a sub-scanning reference signal and a sub-scanning enable signal) for forming an electrostatic latent image of each color is output at a timing corresponding to the conveying speed of the recording material P, i.e., the image forming speed. A method for forming the image-formation timing signal corresponding to the image forming speed will be described in detail later.

The formed electrostatic latent images are developed according to the above-described process. A yellow toner image formed on the photosensitive drum 11*d* present at the most upstream position is subjected to primary transfer onto the intermediate transfer belt 31 at the primary transfer region Td by the charger 35*d* for primary transfer to which a high voltage is applied.

The yellow toner image subjected to primary transfer is conveyed to the next primary transfer region Tc. In the primary transfer region Tc, image formation is performed by being delayed by a time for conveying the toner image between the adjacent image forming units (between the primary transfer regions Td and Tc) by the above-described timing signal, so that the next magenta toner image is transferred on the yellow toner image by being registered. The same processing is repeated until toner images of the four colors are subjected to primary transfer onto the intermediate transfer belt 31 in a superposed state.

Then, when the recording material P enters the secondary transfer region Te and contacts the intermediate transfer belt 31, a high voltage is applied to the secondary transfer roller 36 in synchronism with the timing of passage of the recording material P. Thus, the four-color toner image formed on the intermediate transfer belt 31 according to the above-described process is transferred onto the surface of the recording material P. Then, the recording material P is exactly guided to the nip portion between the pair of fixing rollers 41*a* and 41*b* by the conveying guide 43. The toner image is fixed on the surface of the recording material P by heat of the pair of fixing rollers 41*a* and 41*b*, and pressure at the nip portion. Then, the recording material P is conveyed by the internal and external sheet discharge rollers 44 and 45, respectively, outside of the apparatus.

The process speed and the recording-sheet conveying speed in the above-described image forming operation vary depending on the type of the sheets (the type of the recording material P), environment and the like. The recording-sheet conveying speed is changed by output control of the image-formation timing signal in the sub-scanning direction, and skipping part of BD signals (main-scanning synchronizing signals), without changing the revolution speed of the laser-scanner motor 103.

The details of the processing for changing the recording-sheet conveying speed will now be described. A method for generating an image-formation timing signal for each color in each of an ordinary-speed mode and a deceleration mode (1/2 speed) will be described.

(In the Ordinary-speed Mode)

In the ordinary-speed mode, since it is necessary to perform synchronism control of the laser-scanner motor 103 for each color, control when performing the phase control described with reference to FIG. 9 is performed. When it is detected that the laser-scanner motor 103 for each color has a constant speed and is synchronized with the reference signal, an image-forming-operation start signal is generated from the CPU or the like.

Figure 10:
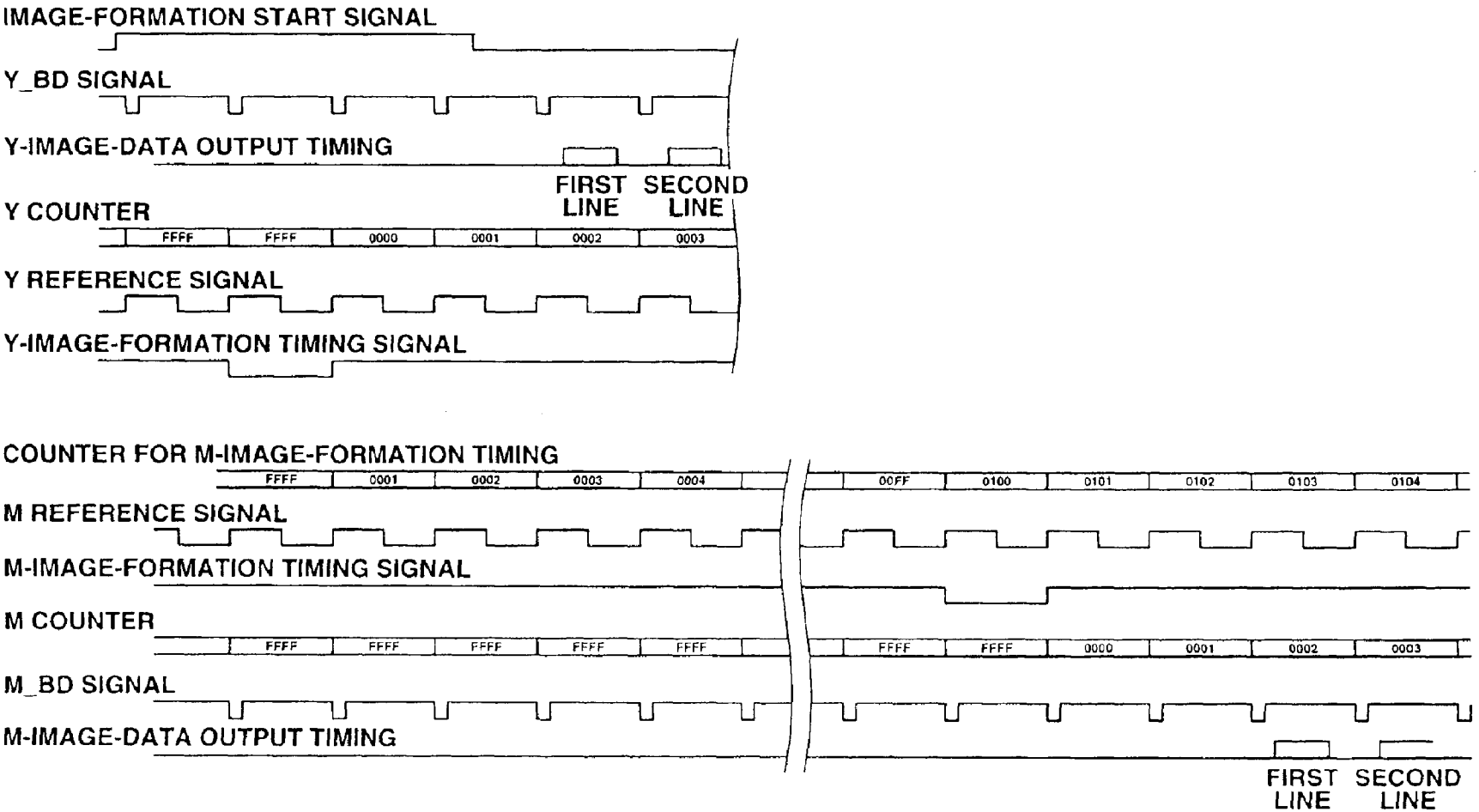
FIG. 10 is a timing chart illustrating yellow- and magenta-image-formation timing signal generation processing at an ordinary speed.
Figure 11:
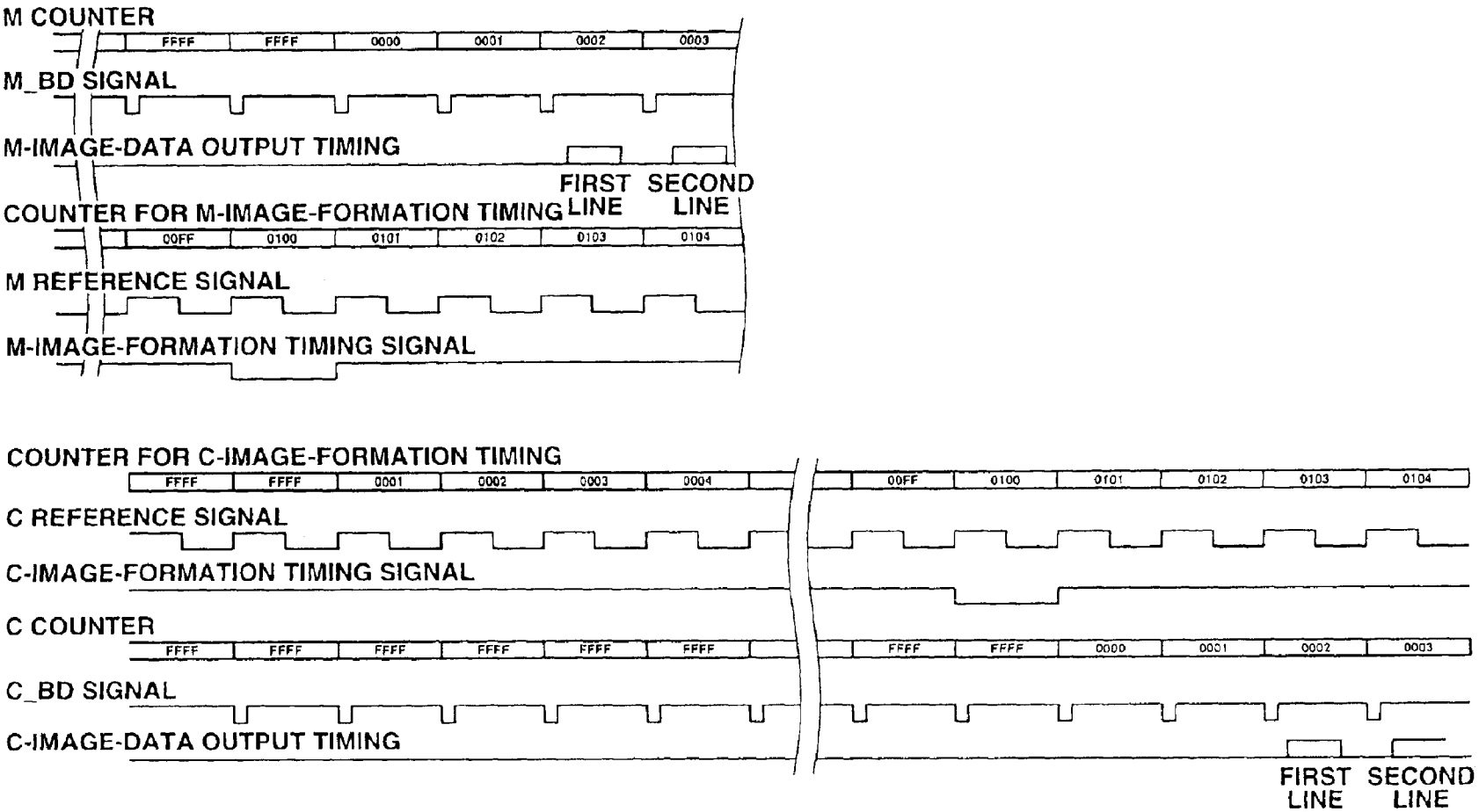
FIG. 11 is a timing chart illustrating magenta- and cyan-image-formation timing signal generation processing at the ordinary speed.
Figure 12:
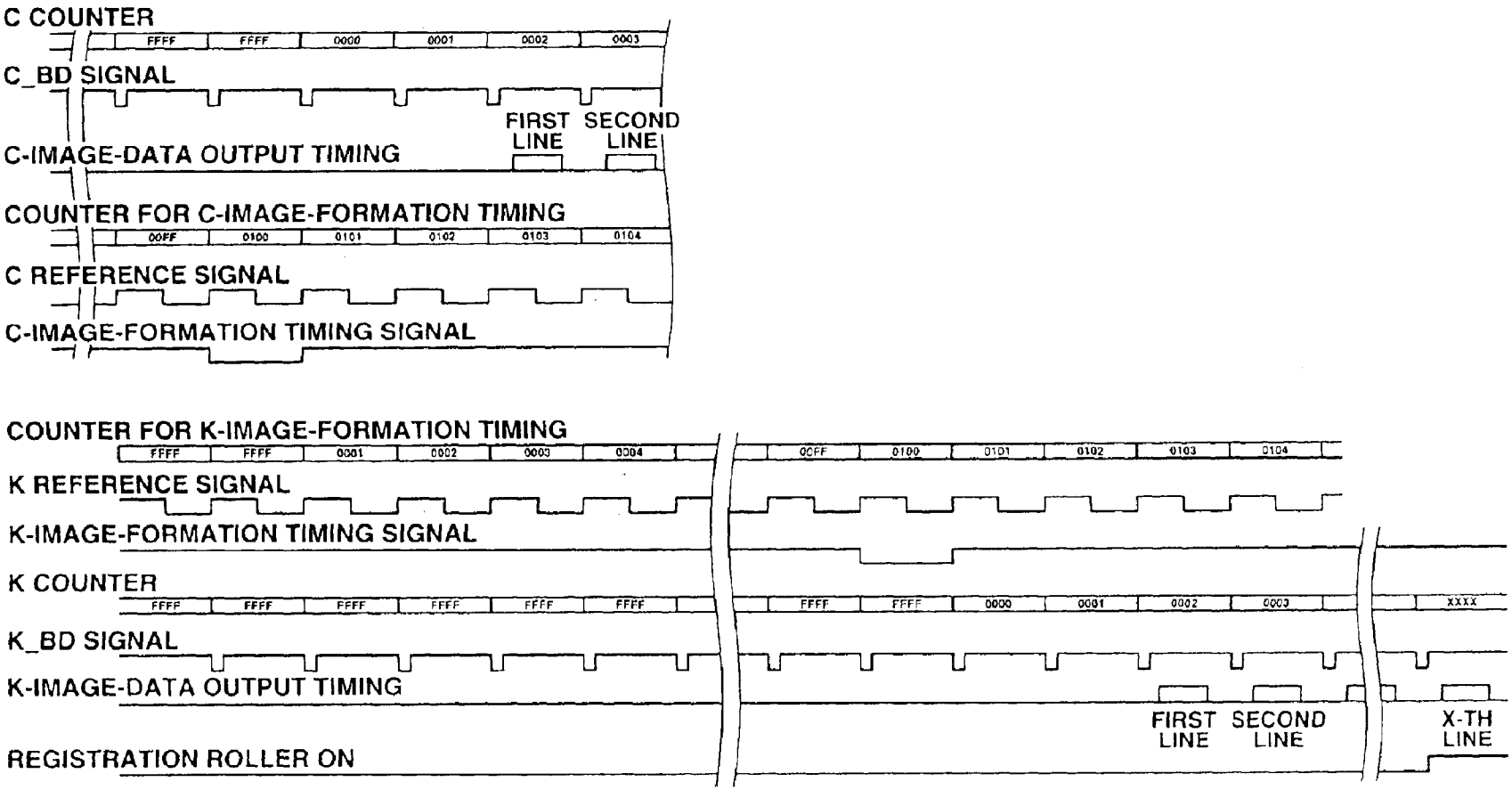
FIG. 12 is a timing chart illustrating cyan- and black-image-formation timing signal generation processing at the ordinary speed.

As shown in FIGS. 10, 11 and 12, an image-formation timing signal for each color is generated for the image-forming-operation start signal as a signal synchronized with a signal (BD signal) of the BD sensor 52 for each color. FIGS. 10, 11 and 12 illustrate timings when the photosensitive drums 11*a*–11*d* are arranged in the order of yellow (Y), magenta (M), cyan (C) and black (B) from the upstream side in the direction of rotation of the intermediate transfer bent 31 (the situation is the same in the case of FIGS. 13, 14 and 15).

FIG. 10 illustrates a yellow(Y)-image-formation timing signal, a magenta(M)-image-formation timing signal, and signals relating to these signals.

When the image-forming-operation start signal is input, the yellow(Y)-image-formation timing signal is generated in synchronization with a yellow BD signal (Y_BD signal). A yellow(Y)-image-data output timing signal is generated and output based on the Y-image-formation timing signal and the Y_BD signal.

The Y-image-formation timing signal is used as a timing signal for clearing a counter for an M-image-formation timing for generating a magenta(M)-image-formation timing signal.

After being cleared in synchronization with the rise of an M reference signal after generating the Y-image-formation timing signal, the counter for the M-image-formation timing counts magenta BD signals (M_BD signals). When the count value of the counter for the M-image-formation timing reaches a predetermined value, a magenta(M)-image-formation timing signal is generated and output.

In FIG. 10, a case in which the M-image-formation timing signal is generated and output when the count value of the counter for the M-image-formation timing reaches a value of 0100 (H). The predetermined count value is determined based on the distance between the yellow-image forming unit and the magenta-image forming unit.

Then, a magenta(M)-image-data output timing signal is generated and output based on the M-image-formation timing signal and the M_BD signal. More specifically, the M-image-data output timing signal is generated in synchronization with a predetermined number (for example, 3) of M_BD signals after the M-image-formation timing signal has been generated.

The M-image-formation timing signal is used as a timing signal for clearing a counter for a C-image-formation timing for generating a cyan(C)-image-formation timing signal.

FIG. 11 illustrates timing signals relating to the above-described case. In FIG. 11, a case in which the phases of magenta (M) and cyan (C) reference signals shift by 1/2 with each other is illustrated.

After being cleared in synchronization with the rise of a C reference signal after generating the M-image-formation timing signal, the counter for the C-image-formation timing counts cyan BD signals (C_BD signals). When the count value of the counter for the C-image-formation timing reaches a predetermined value, a cyan(C)-image-formation timing signal is generated and output.

In FIG. 11, a case in which the C-image-formation timing signal is generated and output when the count value of the counter for the C-image-formation timing reaches a value of 0100 (H). The predetermined count value is determined based on the distance between the magenta-image forming unit and the cyan-image forming unit.

Then, a cyan(C)-image-data output timing signal is generated and output based on the C-image-formation timing signal and the C_BD signal.

The C-image-formation timing signal is used as a timing signal for clearing a counter for a K-image-formation timing for generating a black (K)-image-formation timing signal.

FIG. 12 illustrates timing signals relating to the above-described case. In FIG. 12, a case in which the phases of cyan (C) and black (K) reference signals shift by 3/4 with each other is illustrated.

After being cleared in synchronization with the rise of a K reference signal after generating the C-image-formation timing signal, the counter for the K-image-formation timing counts black (K) BD signals (K_BD signals). When the count value of the counter for the K-image-formation timing reaches a predetermined value, a black(K)-image-formation timing signal is generated and output.

In FIG. 12, a case in which the black(K)-image-formation timing signal is generated and output when the count value of the counter for the K-image-formation timing reaches a value of 0100 (H). The predetermined count value is determined based on the distance between the cyan-image forming unit and the black-image forming unit.

Then, a black(K)-image-data output timing signal is generated and output based on the K-image-formation timing signal and the K_BD signal. A rotation start timing signal for the registration rollers 25*a* and 25*b* is generated based on an image-formation timing signal for the image forming unit at the most downstream portion (black in this case), and a BD signal for that image forming unit.

(Deceleration Mode)

As an example of a deceleration mode, a description will be provided of a case in which the conveying speed of the recording sheet P is 1/2 of the speed during the ordinary-speed mode, and the revolution speed of the laser-scanner motor 103 for each color is not changed. In the deceleration mode, since it is also necessary to perform synchronism control of the laser-scanner motor 103 for each color, the control when performing phase control described with reference to FIG. 9 is performed. A method for selecting a reference signal used for performing the phase control will be described in detail later.

Figure 13:
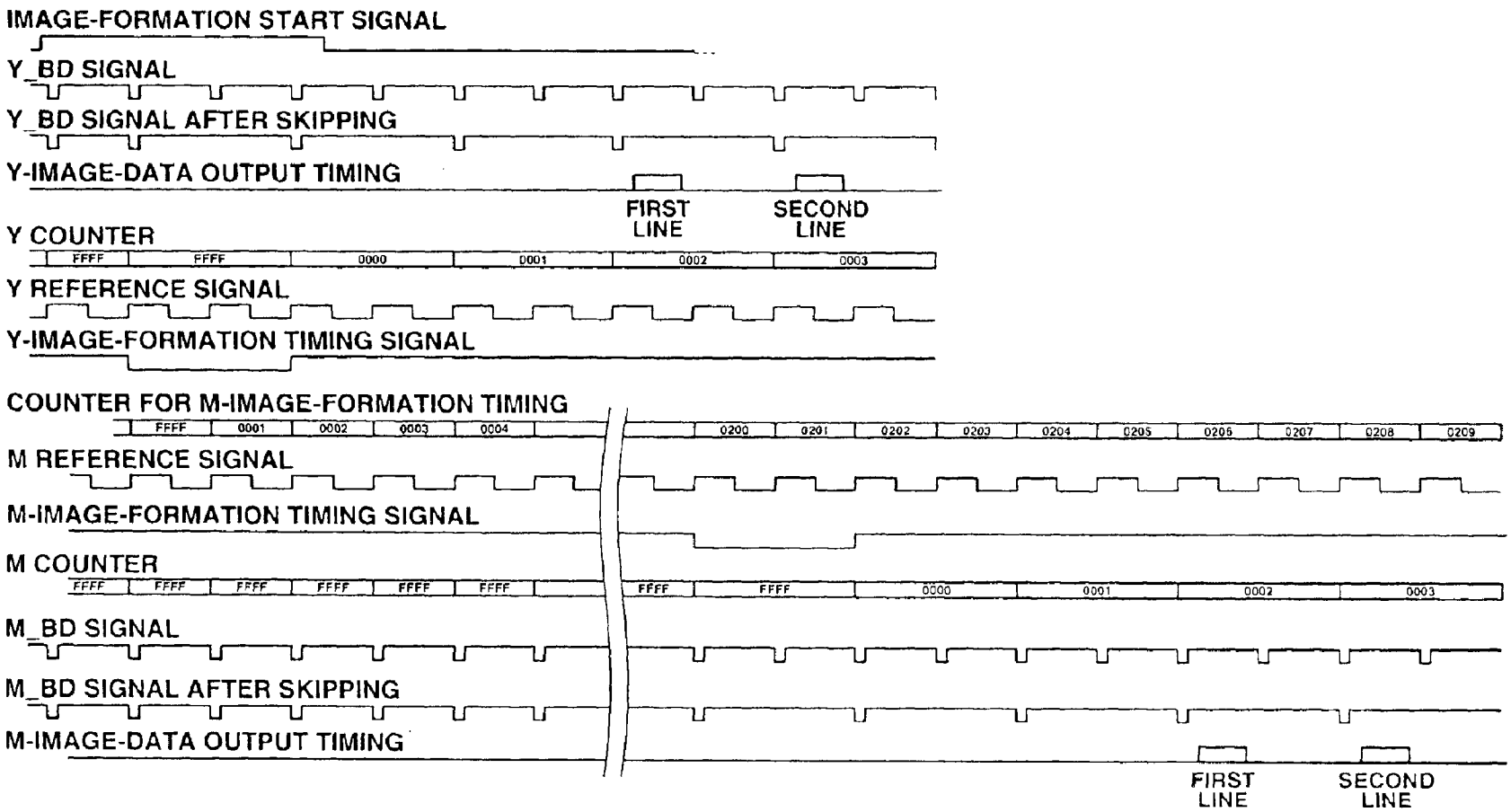
FIG. 13 is a timing chart illustrating yellow- and magenta-image-formation timing signal generation processing during deceleration (1/2 speed)
Figure 14:
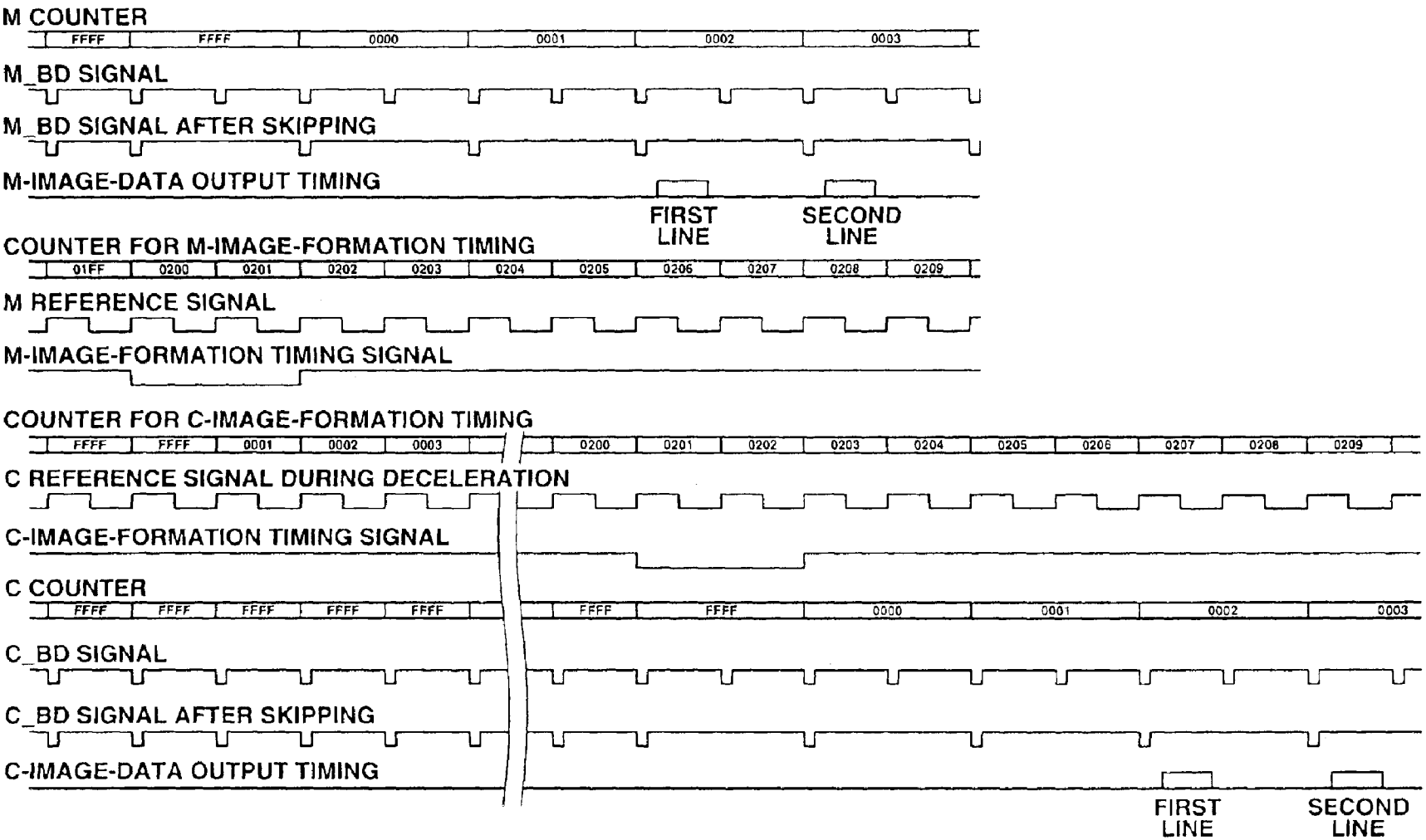
FIG. 14 is a timing chart illustrating magenta- and cyan-image-formation timing signal generation processing during deceleration (1/2 speed)
Figure 15:
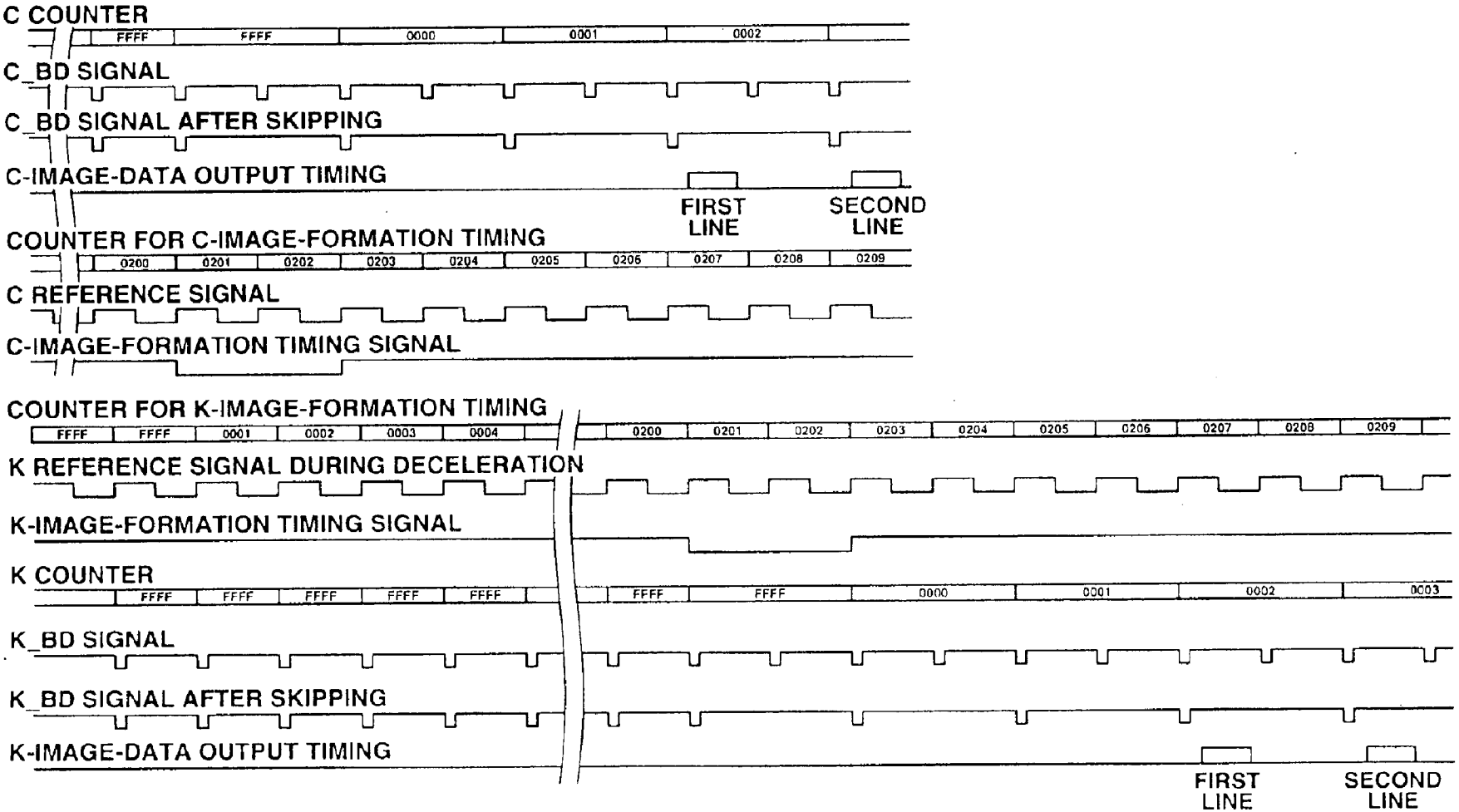
FIG. 15 is a timing chart illustrating cyan- and black-image-formation timing signal generation processing during deceleration (1/2 speed).

When it is detected that the laser-scanner motor 103 for each color has a constant speed and is synchronized with a reference signal for each color, an image-forming-operation start signal is generated from the CPU or the like. As shown in FIGS. 13, 14 and 15, a sub-scanning image-formation timing signal and a main-scanning image-formation timing signal for each color are generated for the image-forming-operation start signal.

FIG. 13 illustrates a yellow(Y)-image-formation timing signal, a magenta(M)-image-formation timing signal, and signals relating to these signals.

When a deceleration mode (1/2 speed) has been selected, first, from a count value 0100 (H) (see FIG. 10) corresponding to the interval between yellow (Y) and magenta (M) sub-scanning image-formation timing signals in the case of the ordinary speed and a yellow (Y) reference signal selected at phase control, in order to output a Y-image-formation timing signal at magenta (M) sub-scanning, a count value by the counter for the magenta(M)-image-formation timing, and an M reference signal for phase control of magenta (M) are obtained. In this case, since reference signals selected at yellow and magenta phase controls have the same phase, the following equation is obtained:

$$0100(H)\times 2=0200(H).$$

This indicates that 0200 (H) is set as the count value by the counter for the M-image-formation timing, and the phase difference between yellow and magenta reference signals for phase control is made 0.

When the image-forming-operation start signal has been input, a yellow(Y)-image-formation timing signal is generated in synchronization with a yellow BD signal (Y_BD signal) after skipping part of the Y_BD signal. A yellow (Y)-image-data output timing signal is generated based on the Y-image-formation timing signal and the Y_BD signal after skipping.

The Y-image-formation timing signal is used as a timing signal for clearing a counter for an M-image-formation timing for generating a magenta(M)-image-formation timing signal.

After being cleared in synchronization with an M reference signal after generating the Y-image-formation timing signal, the counter for the M-image-formation timing counts magenta (M) BD signals (M_BD signals). When the count value of the counter for the M-image-formation timing reaches a predetermined value, a sub-scanning magenta(M)-image-formation timing signal is generated and output.

In FIG. 13, the sub-scanning magenta(M)-image-formation timing signal is generated and output when the count value of the counter for the M-image-formation timing reaches the above-described value of 0200 (H). Upon start of skipping from the next magenta (M) BD signal (M_BD signal) after generation of the M-image-formation timing signal, a magenta(M)-image-data output timing signal is generated and output based on the sub-scanning magenta (M)-image-formation timing signal and the M_BD signal after skipping.

Next, a cyan(C)-image-formation timing signal will be described. In the case of the ordinary speed, the count value corresponding to the interval between sub-scanning image-formation timing signals for magenta (M) and cyan (C) is 0100 (H) (see FIG. 11), and reference signals selected at phase control have a phase difference of 1/2. The count value for outputting a sub-scanning cyan-image-formation timing signal in this case is obtained as follows:

$$0100(H)\times 2=0200(H)$$

$$1/2\times 1=1$$

Accordingly, 0200+0001=0201 (H).

This indicates that 0201 (H) is set as the count value by the counter for the C-image-formation timing, and the phase difference between magenta and cyan reference signals for phase control is made 0.

FIG. 14 illustrates a magenta(M)-image-formation timing signal, a cyan(C)-image-formation timing signal, and signals relating to these signals. The magenta(M)-image-formation timing signal is used as a timing signal for clearing the counter for the C-image-formation timing for generating a cyan(C)-image formation timing signal.

After being cleared in synchronization with a C reference signal after generating the M-image-formation timing signal, the counter for the C-image-formation timing counts cyan BD signals (C_BD signals). When the count value of the counter for the C-image-formation timing reaches a predetermined value, a sub-scanning magenta(M)-image-formation timing signal is generated and output.

In FIG. 14, a sub-scanning cyan(C)-image-formation timing signal is generated and output when the count value of the counter for the M-image-formation timing reaches the above-described value of 0201 (H). Upon start of skipping from the next cyan (C) BD signal (C_BD signal) after generation of the C-image-formation timing signal, a cyan (C)-image-data output timing signal is generated and output based on the sub-scanning cyan(C)-image-formation timing signal and the C_BD signal after skipping.

Next, a black(K)-image-formation timing signal will be described. In the case of the ordinary speed, the count value corresponding to the interval between sub-scanning image-formation timing signals for cyan (C) and black (K) is 0100 (H) (see FIG. 11), and reference signals selected at phase control have a phase difference of 1/4. The count value for outputting a sub-scanning black-image-formation timing signal in this case is obtained as follows:

$$0100(H)\times 2=0200(H)$$

$$1/4\times 2=3/2=1+1/2.$$

This indicates that 0201 (H) is set as the count value by the counter for the K-image-formation timing, and the phase difference between cyan and black reference signals for phase control is made 1/2.

FIG. 15 illustrates a cyan(C)-image-formation timing signal, a black(K)-image-formation timing signal, and signals relating to these signals.

First, the polygonal-mirror motors 13*b* and 13*a* for cyan and black, respectively, are controlled so as to have a phase difference of 1/2.

The cyan(C)-image-formation timing signal is used as a timing signal for clearing the counter for the K-image-formation timing for generating a black(K)-image formation timing signal.

After being cleared in synchronization with a K reference signal after generating the C-image-formation timing signal, the counter for the K-image-formation timing counts black (K) BD signals (K_BD signals). When the count value of the counter for the K-image-formation timing reaches a predetermined value, a sub-scanning black(K)-image-formation timing signal is generated and output.

In FIG. 15, a sub-scanning black(K)-image-formation timing signal is generated and output when the count value of the counter for the K-image-formation timing reaches the above-described value of 0201 (H). Upon start of skipping from the next black (K) BD signal (K_BD signal) after generation of the K-image-formation timing signal, a black (K)-image-data output timing signal is generated and output based on the sub-scanning black(K)-image-formation timing signal and the K_BD signal after skipping.

A rotation start timing for the registration rollers 25*a* and 25*b* is generated based on a sub-scanning K-image-formation timing signal for the image forming unit at the most downstream portion (black in this case), and a K_BD signal after skipping.

As described above, in this embodiment, when dealing with deceleration in the sheet feeding speed without changing the revolution speed of the polygonal-mirror motor, by controlling a timing of line skipping using an image-formation timing signal in the sub-scanning direction of the image forming unit at the preceding stage and a main-scanning synchronizing signal not performing skipping, deviation among images of respective colors is prevented.

The present invention is not limited to the above-described embodiment. For example, instead of the case of a conveying speed of 1/2, the case of a conveying speed of 1/3–1/n can also be dealt with by multiplying the count value of the counter for outputting a sub-scanning image-formation timing signal during an ordinary operation, and the phase difference between reference signals for phase control by 3–n, respectively.

The present invention may also be applied to an apparatus in which a toner image is directly transferred from a photosensitive member onto a recording sheet without using an intermediate transfer belt.

The objects of the present invention may, of course, also be achieved by supplying a system or an apparatus with a storage medium (or a recording medium) storing program codes of software for realizing the functions of the above-described embodiment, and reading and executing the program codes stored in the storage medium by means of a computer (or a CPU or an MPU (microprocessor unit)) of the system or the apparatus.

In such a case, the program codes themselves read from the storage medium realize the functions of the above-described embodiment, so that the storage medium storing the program codes constitutes the present invention.

For example, a floppy disk, a hard disk, a magnetooptical disk, a CD(compact disc)-ROM, a CD-R (recordable), a CD-RW (rewritable), a DVD(digital versatile disc)-ROM, a DVD-RAM, a DVD-RW, a magnetic tape, a nonvolatile memory card, a ROM or the like may be used as the storage medium for supplying the program codes.

The present invention may, of course, be applied not only to a case in which the functions of the above-described embodiment are realized by executing program codes read by a computer, but also to a case in which an OS (operating system) or the like operating in a computer executes a part or the entirety of actual processing, and the functions of the above-described embodiment are realized by the processing.

The present invention may, of course, be applied to a case in which, after writing program codes read from a storage medium into a memory provided in a function expanding card inserted into a computer or in a function expanding unit connected to the computer, a CPU or the like provided in the function expanding card or the function expanding unit performs a part or the entirety of actual processing based on instructions of the program codes, and the functions of the above-described embodiment are realized by the processing. When applying the present invention to the storage medium, program codes corresponding to the above-described timing charts (shown in FIGS. 13–15) are stored in the storage medium.

The individual components shown in outline or designated by blocks in the drawings are all well known in the image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for controlling an image forming apparatus for forming a color image by superposing images formed at image forming units, each provided for a corresponding one of a plurality of color components, said method comprising:

a first skipping step of skipping part of a main-scanning synchronizing signal in a first image forming unit for forming an image of a first color component;

a first generation step of generating a sub-scanning reference signal based on the main-scanning synchronizing signal skipped in said first skipping step;

a first exposure-scanning control step of controlling exposure scanning in the first image forming unit based on the main-scanning synchronizing signal skipped in said first skipping step and the sub-scanning reference signal generated in said first generation step;

a second generation step of generating a sub-scanning reference signal in a second image forming unit for forming an image of a second color component, based on the sub-scanning reference signal generated in said first generation step;

a second skipping step of performing skipping by determining a timing of skipping of the main-scanning synchronizing signal in the second image forming unit based on the sub-scanning reference signal generated in said second generation step; and a second exposure-scanning control step of controlling exposure scanning in the second image forming unit based on the main-scanning synchronizing signal skipped in said second skipping step and the sub-scanning reference signal generated in said second generation step.

2. A method according to claim 1, wherein said first and second skipping steps are executed in a low-speed mode in which image formation is performed at a speed lower than an ordinary image forming speed.

3. A method according to claim 2, wherein in the low-speed mode, a rotation speed of a rotating polygonal mirror is maintained at the same value as in an ordinary mode.

4. A method according to claim 1, wherein each of the plurality of image forming units has a generation step of generating a reference signal for controlling a rotation phase of a rotating polygonal mirror.

5. A method according to claim 4, wherein in said generation step, a plurality of reference signals having different phases can be generated, and one of the generated reference signals is selected and used.

6. A method according to claim 1, wherein in said second generation step, an output timing of the sub-scanning reference signal in the second image forming unit is determined by counting a predetermined number of main-scanning synchronizing signals before skipping in the second image forming unit, starting from a time when the sub-scanning reference signal in the first image forming unit is output in said first generation step.

7. A method according to claim 4, wherein in said second generation step, an output timing of the sub-scanning reference signal in the second image forming unit is determined from a degree of deceleration from an ordinary image forming speed, and by counting main-scanning synchronizing signals before skipping in the second image forming unit, having a number corresponding to a phase difference between a reference signal in the first image forming unit and a reference signal in the second image forming unit at an ordinary image forming speed.

* * * * *